US008602325B2

(12) United States Patent
Clark et al.

(10) Patent No.: US 8,602,325 B2
(45) Date of Patent: Dec. 10, 2013

(54) HYDRAULICALLY ACTUATED SPRINKLER NOZZLE COVER

(75) Inventors: Michael L. Clark, San Marcos, CA (US); Daniel E. Hunter, Vista, CA (US); Zachary B. Simmons, Escondido, CA (US)

(73) Assignee: Hunter Industries, Inc., San Marcus, CA (US)

( * ) Notice: Subject to any disclaimer, the term of this patent is extended or adjusted under 35 U.S.C. 154(b) by 953 days.

(21) Appl. No.: 12/044,205

(22) Filed: Mar. 7, 2008

(65) Prior Publication Data

US 2009/0224070 A1 Sep. 10, 2009

(51) Int. Cl.
*B05B 3/02* (2006.01)

(52) U.S. Cl.
USPC ..... 239/222.11; 239/206; 239/222.17; 239/237; 239/288.5

(58) Field of Classification Search
USPC ..... 239/107, 200–206, 237, 240, 263, 546, 239/222.11, 222.17, 288, 288.5
See application file for complete search history.

(56) References Cited

U.S. PATENT DOCUMENTS

| | | | | |
|---|---|---|---|---|
| 1,192,743 | A | 7/1916 | Brooks | |
| 1,764,570 | A | 6/1930 | Lohman | |
| 1,770,764 | A | 7/1930 | Brooks | |
| 2,493,595 | A | 1/1950 | Rieger | 299/126 |
| 3,724,757 | A * | 4/1973 | Hunter | 239/205 |
| 3,854,664 | A | 12/1974 | Hunter | 239/206 |
| 4,182,494 | A | 1/1980 | Wichman et al. | 239/230 |
| 4,353,506 | A | 10/1982 | Hayes | 239/206 |
| 4,471,908 | A | 9/1984 | Hunter | 239/11 |
| 4,815,662 | A | 3/1989 | Hunter | 239/222 |
| 4,842,201 | A | 6/1989 | Hunter | 239/396 |
| 4,867,379 | A | 9/1989 | Hunter | 239/240 |
| 4,898,332 | A * | 2/1990 | Hunter et al. | 239/240 |
| 4,932,590 | A | 6/1990 | Hunter | 239/222 |
| 4,967,961 | A | 11/1990 | Hunter et al. | 239/240 |
| 4,971,250 | A | 11/1990 | Hunter | 239/222.17 |
| 5,058,806 | A | 10/1991 | Rupar | 239/205 |
| 5,288,022 | A | 2/1994 | Sesser | 239/205 |
| 5,381,959 | A * | 1/1995 | Malkin | 239/201 |
| 5,641,122 | A * | 6/1997 | Alkalai et al. | 239/206 |
| 5,823,435 | A * | 10/1998 | Morgan et al. | 239/107 |
| 5,899,386 | A | 5/1999 | Miyasato et al. | 239/289 |
| 6,244,521 | B1 | 6/2001 | Sesser | 239/222.17 |
| 6,499,672 | B1 | 12/2002 | Sesser | 239/222.11 |
| 6,651,905 | B2 | 11/2003 | Sesser | 239/205 |
| 6,688,539 | B2 | 2/2004 | Griend | 239/222.11 |
| 6,736,332 | B2 | 5/2004 | Sesser et al. | 239/204 |
| 6,814,304 | B2 | 11/2004 | Onofrio | 239/201 |
| 7,025,282 | B2 * | 4/2006 | Hong | 239/24 |
| 7,032,836 | B2 | 4/2006 | Sesser et al. | 239/204 |
| D527,791 | S | 9/2006 | Onofrio et al. | D23/214 |
| 7,159,795 | B2 | 1/2007 | Sesser et al. | 239/203 |
| 7,255,291 | B1 * | 8/2007 | Lo | 239/242 |
| 2004/0262426 | A1 | 12/2004 | Antonucci et al. | 239/233 |

* cited by examiner

*Primary Examiner* — Jason Boeckmann
(74) *Attorney, Agent, or Firm* — Knobbe, Martens, Olson & Bear LLP

(57) ABSTRACT

A sprinkler includes a nozzle and a cover configured for enclosing the nozzle. A hydraulically actuated mechanism supports the cover above the nozzle for reciprocation relative to the nozzle between a lower closed position and a raised open position.

19 Claims, 9 Drawing Sheets

HYDRAULICALLY ACTUATED SPRINKLER NOZZLE COVER

FIELD OF THE INVENTION

The present invention relates to sprinklers used to irrigate turf and landscaping.

BACKGROUND OF THE INVENTION

Many geographic locations have dry spells and/or insufficient rainfall requiring turf and landscaping to be watered to maintain the proper health of the vegetation. Turf and landscaping are often watered utilizing an automatic irrigation system that includes a programmable controller that turns a plurality of valves ON and OFF to supply water through underground pipes connected to sprinklers. Golf courses, playing fields and other large areas typically require rotor-type sprinklers that eject a long stream of water via a single relatively large nozzle that oscillates through an adjustable arc. Smaller areas are often watered with spray heads or rotary stream sprinklers. Spray heads eject a fan-shaped pattern of water at a relatively high rate and much of this water often flows off the vegetation and/or blows away and is wasted. Rotary stream sprinklers eject relatively small individual streams of water and use less water than spray head sprinklers. In some cases drip nozzles are employed in residential and commercial irrigation systems for watering trees and shrubs, for example.

Sprinklers used to irrigate turf and landscaping are exposed to many forces and contaminants that can adversely impact the performance of the sprinklers and in some cases render them completely inoperable. Rotary stream sprinklers are especially vulnerable to impaired performance due to the ingress of dirt and grit and the build up of calcium deposits. Rotary stream sprinklers typically include a nozzle head or stream deflector having flutes formed on the underside thereof that receive water from orifices in a nozzle plate and channel streams of water radially outward onto the turf or landscaping. The flutes and orifices can become clogged with dirt and grit, particularly where the sprinkler nozzle retracts to the level of the ground. Over time, calcium and other mineral deposits can build up due to evaporation and constrict or obstruct the flutes and/or orifices, particularly when the orifices are very small as required to produce a rotary stream sprinkler with a very small flow rate. For example, a round orifice in the nozzle plate might be only 0.015 inches in diameter in order to provide a rotary stream sprinkler with a flow rate of four gallons per hour. Such a low volume rotary stream sprinkler would be particularly desirable because it could be substituted for a spray head and result in substantial water savings.

Rotary stream sprinklers either employ a reactionary drive or a gear reduction in order to slowly rotate the stream deflector to optimize the water distribution. When a reactionary drive is employed, the flutes are angled so that the water ejected by the stream deflector rotates the same. A viscous damper or friction brake must be used to slow the rotation of the stream deflector with angled flutes. In a rotary stream sprinkler with a reactionary drive, the stream deflector can pop-up from a protective outer cylindrical base when the water is turned ON, and retract into the protective outer base, thereby providing a degree of protection of the flutes and nozzle plate orifices from dirt, debris and mineral deposit build-up due to evaporation. However, pop-up operation of the stream deflector is not practical in a rotary stream sprinkler that employs a gear reduction for driving the stream deflector. Therefore it would be desirable to provide such a sprinkler with an alternate means of protecting its flutes and orifices from debris and mineral build-up due to evaporation.

SUMMARY OF THE INVENTION

In accordance with the present invention, a sprinkler includes a nozzle and a cover configured for enclosing the nozzle. A hydraulically actuated mechanism supports the cover above the nozzle for reciprocation relative to the nozzle between a lower closed position and a raised open position.

DETAILED DESCRIPTION

The entire disclosures of the following U.S. patents disclosing rotary stream sprinklers, which are all assigned to Hunter Industries, Inc., the assignee of the subject application, are hereby incorporated by reference: U.S. Pat. No. 4,842,201 granted Jun. 27, 1989 to Edwin J. Hunter entitled ROTARY STREAM SPRINKLER UNIT; U.S. Pat. No. 4,867,379 granted Sep. 19, 1989 to Edwin J. Hunter entitled ROTARY STREAM SPRINKLER UNIT; U.S. Pat. No. 4,898,332 granted Feb. 6, 1990 to Edwin J. Hunter et al. entitled ADJUSTABLE ROTARY STREAM SPRINKLER; U.S. Pat. No. 4,932,590 granted Jun. 12, 1990 to Edwin J. Hunter entitled ROTARY STREAM SPRINKLER UNIT WITH ROTOR DAMPING MEANS; U.S. Pat. No. 4,967,961 granted Nov. 6, 1990 to Edwin J. Hunter entitled ROTARY STREAM SPRINKLER UNIT; U.S. Pat. No. 4,971,250 granted Nov. 20, 1990 to Edwin J. Hunter entitled ROTARY STREAM SPRINKLER WITH ROTOR DAMPING MEANS, U.S. Pat. No. 5,058,806 granted Oct. 22, 1991 to Robert L. Rupar entitled STREAM PROPELLED ROTARY POP-UP SPRINKLER WITH ADJUSTABLE SPRINKLING PATTERN; U.S. Pat. No. 5,288,022 granted Feb. 22, 1994 to George L. Sesser entitled PART CIRCLE ROTATOR WITH IMPROVED NOZZLE ASSEMBLY; U.S. Pat. No. 6,244,521 granted Jun. 12, 2001 to George Sesser entitled MICRO-STREAM ROTATOR WITH ADJUSTMENT OF THROW RADIUS AND FLOW RATE; U.S. Pat. No. 6,499,672 granted Dec. 31, 2002 to George Sesser entitled MICRO-STREAM ROTATOR WITH ADJUSTMENT OF THROW RADIUS AND FLOW RATE; U.S. Pat. No. 6,651,905 granted Nov. 25, 2003 to George Sesser et al. entitled ADJUSTABLE ARC, ADJUSTABLE FLOW RATE SPRINKLER; U.S. Pat. No. 6,688,539 granted Feb. 10, 2004 to Loren Vander Griend entitled WATER DISTRIBUTION PLATE FOR ROTATING SPRINKLERS; U.S. Pat. No. 6,736,332 granted May 18, 2004 to George L. Sesser et al. entitled ADJUSTABLE ARC, ADJUSTABLE FLOW RATE SPRINKLER; U.S. Pat. No. 7,032,836 granted Apr. 25, 2006 to George Sesser et al. entitled ADJUSTABLE ARC, ADJUSTABLE FLOW RATE SPRINKLER; U.S. Pat. No. 7,159,795 granted Jan. 9, 2007 to George L. Sesser et al. entitled ADJUSTABLE ARC, ADJUSTABLE FLOW RATE SPRINKLER; and U.S. Pat. No. 7,322,533 granted Jan. 29, 2008 to Glendale Grizzle entitled ROTARY STREAM SPRINKLER WITH ADJUSTABLE DEFLECTOR RING. In addition, the entire disclosures of pending U.S. patent application Ser. No. 11/762,678 of Michael L. Clark filed Jun. 13, 2007 entitled "Gear Driven Sprinkler with Top Turbine," and Pending U.S. patent application Ser. No. 11/928,579 of LaMonte D. Porter filed Oct. 30, 2007 entitled "Rotary Stream Sprinkler Nozzle with Offset Flutes," both assigned to Hunter Industries, Inc. are hereby incorporated by reference.

Figure 1:
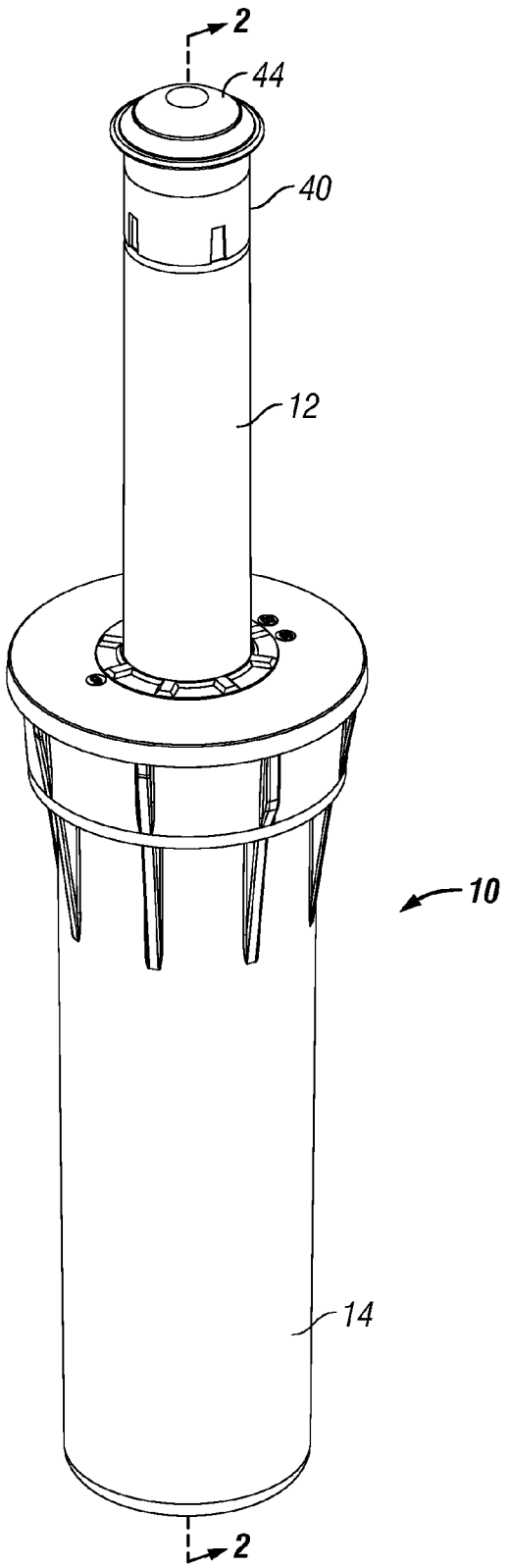
FIG. 1 is a perspective view of a pop-up sprinkler incorporating an embodiment of the present invention. In this view the sprinkler's riser is extended.
Figure 2:
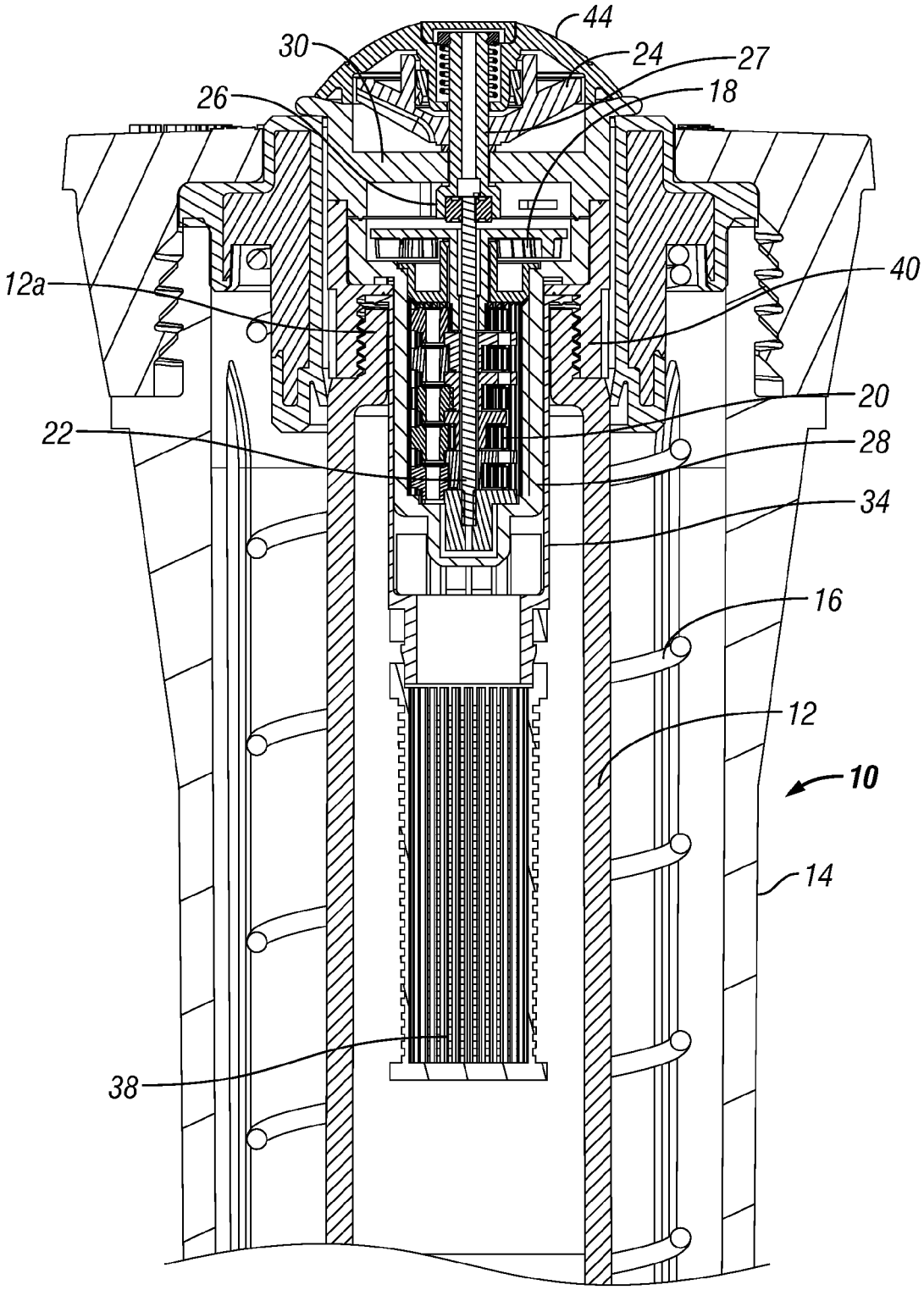
FIG. 2 is an enlarged vertical sectional view of the upper portion of the sprinkler of FIG. 1 taken along line 2-2 of FIG. 1. In this view the sprinkler's riser is retracted.

Referring to FIG. 1, in accordance with an embodiment of the present invention, a pop-up rotary stream sprinkler 10 comprises a tubular riser 12 that telescopes within a cylindrical outer case 14 and is normally held in a retracted position by a coil spring 16 (FIG. 2). A turbine 18 (FIG. 3) is supported above the riser 12 for high speed rotation. The turbine 18 drives an upper input stage of a planetary gear train reduction 20 (FIG. 2). The planetary gear train reduction 20 has a lower output stage that is coupled to the lower end of a drive shaft 22. The drive shaft 22 extends through the axial center of the gear train reduction 20 and loosely through turbine 18. The upper end of the drive shaft 22 is coupled to a nozzle in the form of an inverted frusto-conical rotary stream deflector 24 via clutch dog 26 (FIG. 4) and an elongated clutch member 27. The planetary gear train reduction 20 includes an outer gear box 28 (FIG. 3) that has a ring gear formed on an inner surface thereof.

Figure 3:
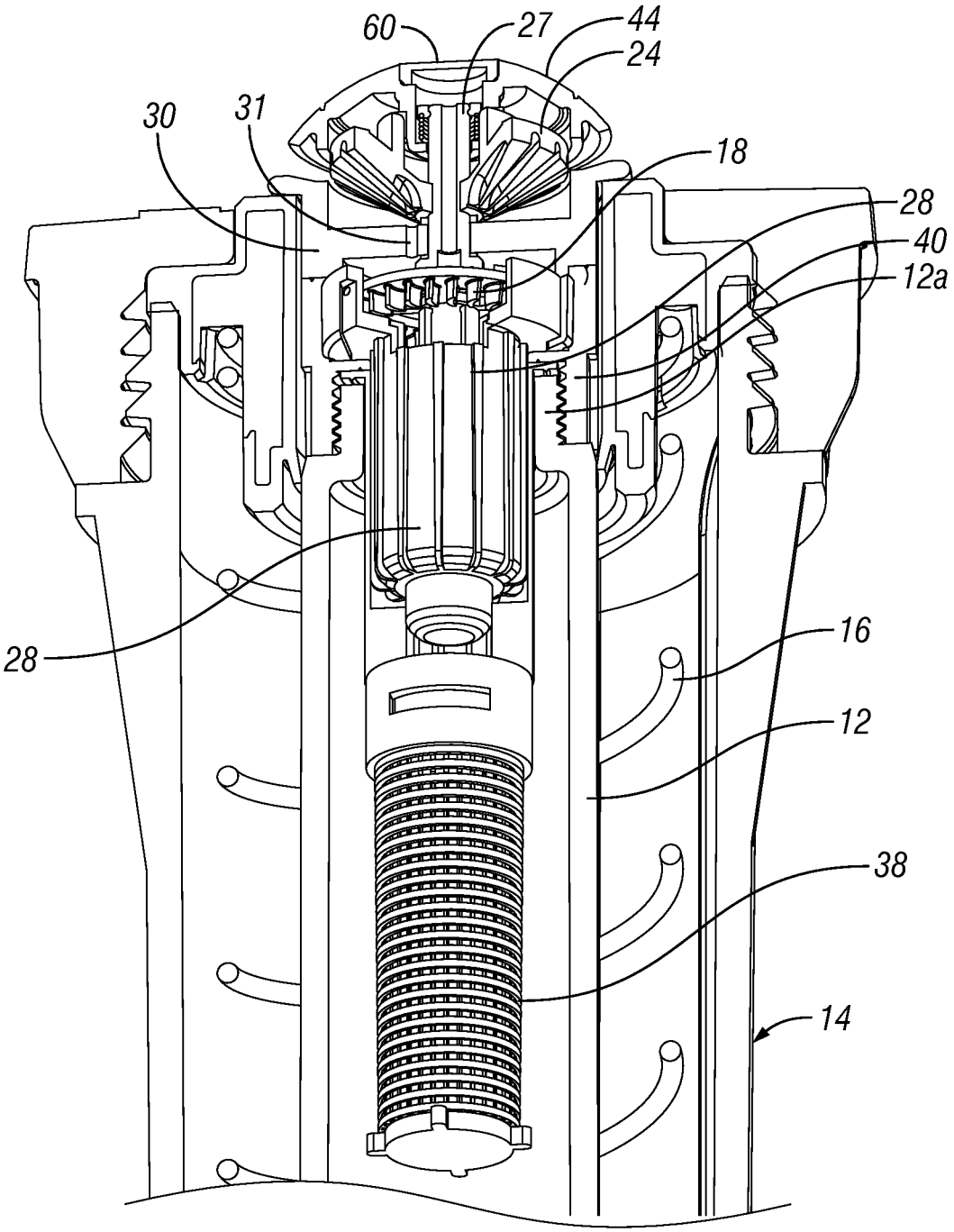
FIG. 3 is an enlarged sectional perspective view of the upper portion of the sprinkler of FIG. 1 with its nozzle cover extended.

Referring still to FIG. 3, the turbine 18 is located at the top of the sprinkler 10 between a nozzle plate 30 and the planetary gear train reduction 20. As used herein, the term "nozzle plate" refers to any structure having a least one orifice for directing water onto the stream deflector and it need not be flat. The nozzle plate 30 could have a configuration similar to one of those disclosed in the U.S. patents and applications listed above. The nozzle plate 30 has a single relatively small round orifice 31 that extends vertically through the nozzle plate 30 and measures, for example, 0.015 inches in diameter.

Figure 4:
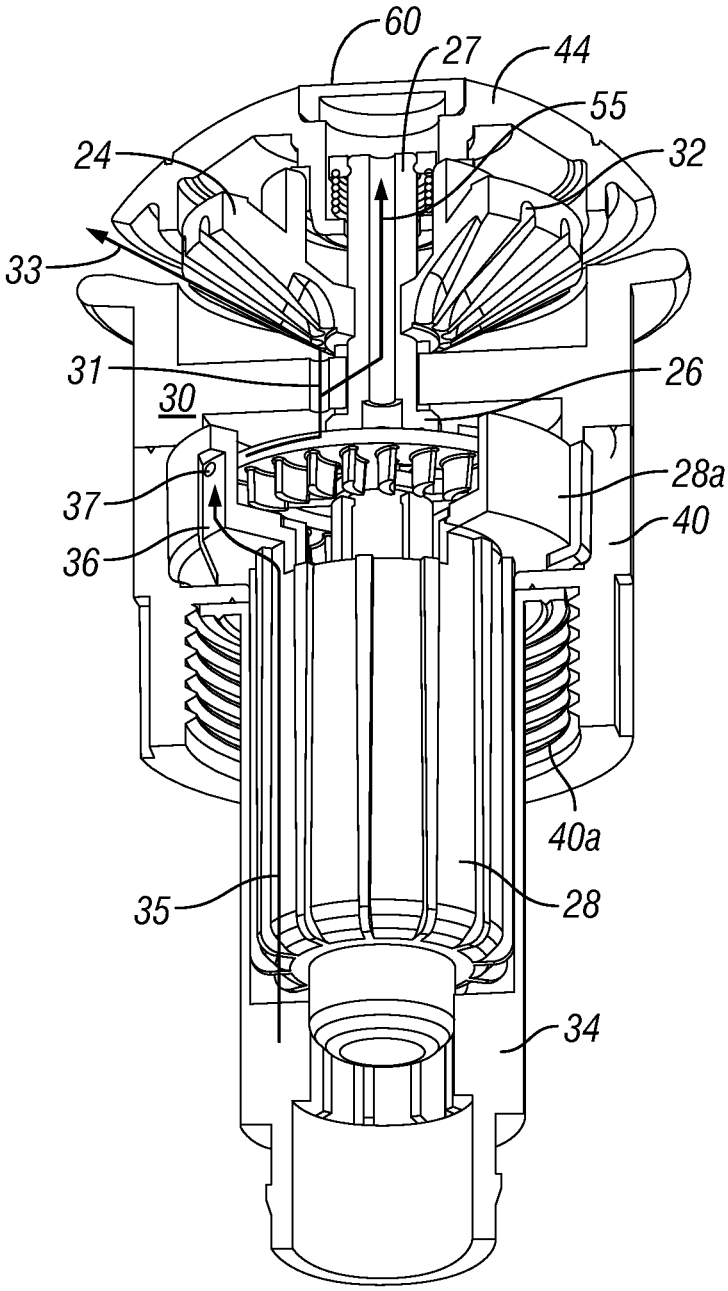
FIG. 4 is a still further enlarged view of the upper portion of the sprinkler of FIG. 1 that is mounted in the top of its riser. The arrows in this view diagrammatically illustrate the water flow path.
Figure 8:
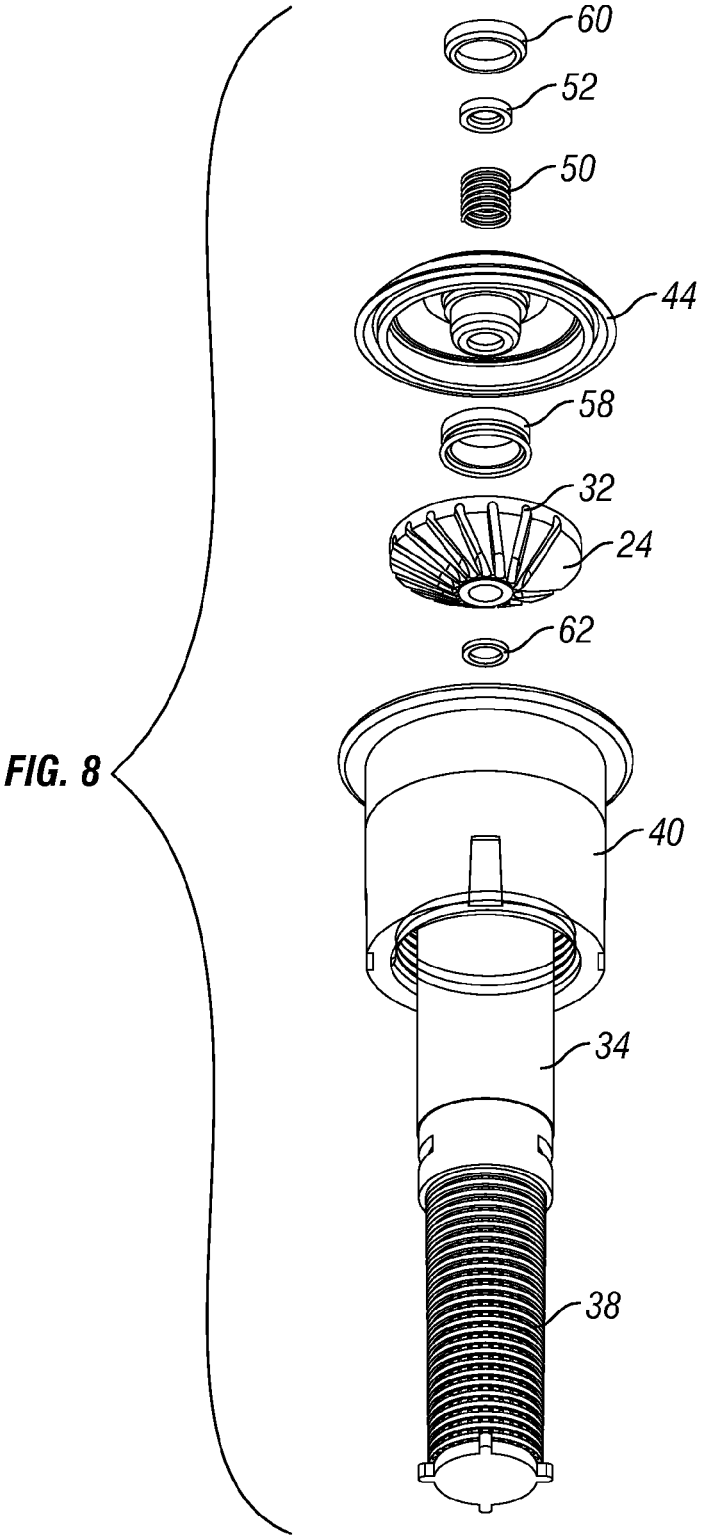
FIG. 8 is an view similar to FIG. 7 taken from below.

The rotary stream sprinkler 10 can have a very low rate of precipitation, e.g. approximately four gallons per hour or less, when the sprinkler 10 is coupled to a source of water pressurized between about 20 and 50 PSI. As illustrated in FIG. 4, water is expelled vertically upward through the orifice 31 in the nozzle plate 30 onto the inner ends of a plurality of generally vertically inclined, radially extending flutes 32 formed on the underside of the stream deflector 24 as each inner end comes into alignment with the orifice. As best seen in FIG. 8, the flutes 32 are formed so that successive streams of water 33 extend at different lateral angles as the stream deflector 24 continuously rotates. The trajectories of the successive streams of water progress so that eventually water has been supplied over all of the desired shape of coverage. Most of the time only a single stream of water is ejected from the sprinkler 10 onto adjacent turf or landscaping, except when water from the orifice in the nozzle plate 30 is transitioning between two adjacent flutes 32. The shape of precipitation coverage by the sprinkler 10 may include a ninety degree arc, a one hundred and eighty degree arc, for example, as well as other shapes such as rectangles. Multiple orifices in the nozzle plate 30 may also be utilized.

The location of the turbine 18 at the top of the rotary stream sprinkler 10 above the planetary gear train reduction 20 substantially eliminates the pressure difference that would otherwise tend to cause dirt and other debris to enter the gear box 28 through a turbine shaft bearing conventionally located in the lower end of the gear box 28. The top placement of the turbine 18 also reduces adverse effects of water and air surges that could damage a turbine conventionally located at the lower inlet end of the device. Locating the turbine 18 at the top of the rotary stream sprinkler 10 also allows the turbine 18 to have a larger diameter which produces a larger drive force for the stream deflector 24. The additional water flow needed for large radius or arc of coverage does not have to flow around the turbine 18, thereby providing increased torque.

While the gear train reduction 20 has the configuration of a planetary gear drive, other forms of gear train reduction could also be used such as a staggered gear train reduction of the type illustrated in FIG. 4 of pending U.S. patent application Ser. No. 11/846,480 filed Aug. 28, 2007 of Ronald H. Anuskiewicz et al., assigned to Hunter Industries, Inc., hereby incorporated by reference, for example.

A cylindrical housing 34 (FIG. 4) surrounds and supports the gear box 28 and defines a primary flow path 35 leading to the turbine 18. The flow path 35 extends between the gear box 28 and the lower splined portion of the gear box 28. The gear box 28 has an enlarged diameter upper portion 28*a*. The upper portion 28*a* of the gear box has a generally cylindrical chamber 36 into which the water flow path 35 leads. Water exits the chamber 36 through one or more small ports 37 and impinges on the turbine 18 to spin the same at high RPM.

A screen 38 (FIG. 3) snap fits into the lower end of the housing 34 and filters dirt and other debris. A cylindrical nozzle base 40 (FIG. 4) surrounds the turbine 18 and the gear box 28. The nozzle base 40 has a lower female threaded segment 40*a* for screwing over the male threaded upper segment 12*a* (FIG. 3) of the riser 12. The nozzle base 40 could also be screwed over the male threaded upper segment of a fixed riser in which case the sprinkler would not be in a pop-up configuration. The nozzle base 40 could be reconfigured to have a male threaded segment for screwing over a female threaded upper segment of a fixed riser.

Figure 5A:
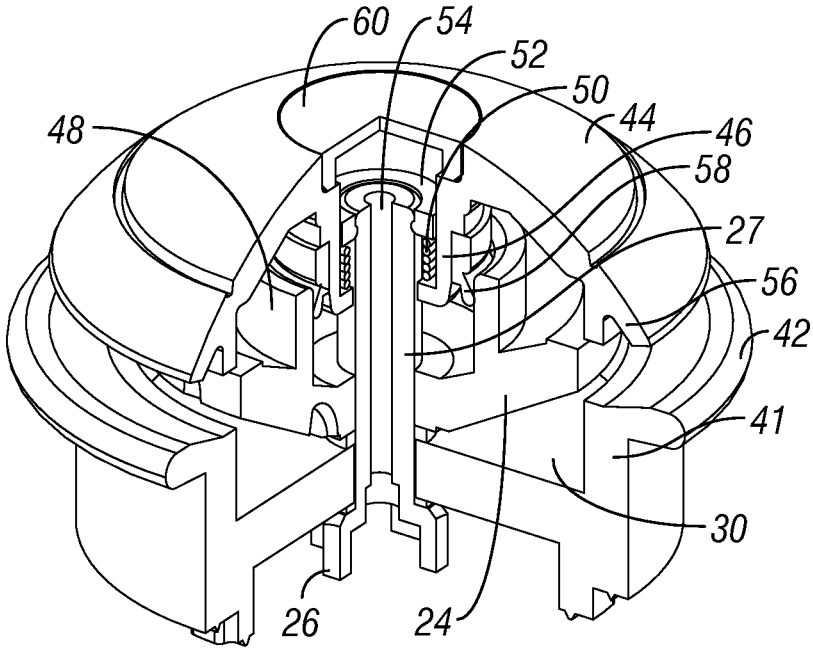
FIG. 5A is a fragmentary view of the nozzle and hydraulically actuated nozzle cover of the sprinkler of FIG. 1 with the cover in its raised open position.
Figure 5B:
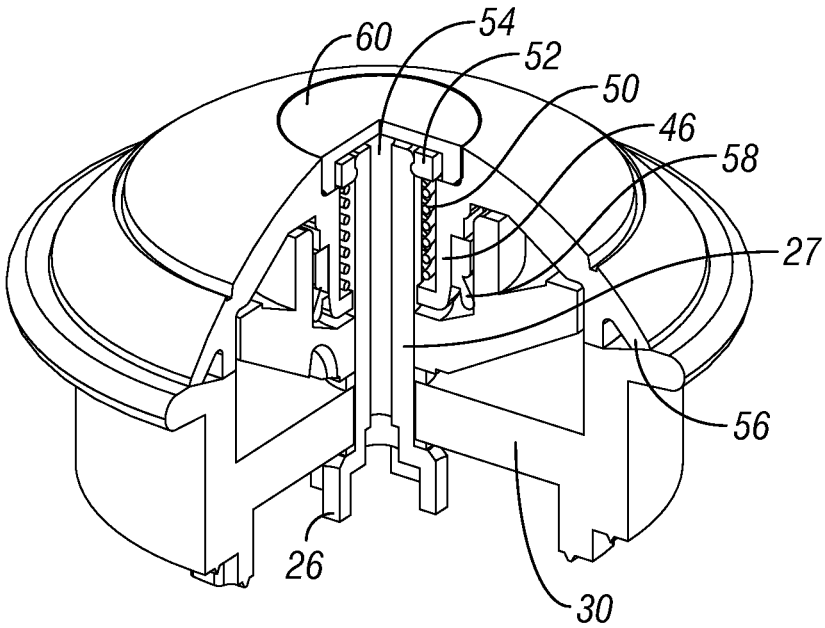
FIG. 5B is a fragmentary perspective view, taken from above, of the nozzle and hydraulically actuated nozzle cover of the sprinkler of FIG. 1 with the cover in its lower closed position.
Figure 6A:
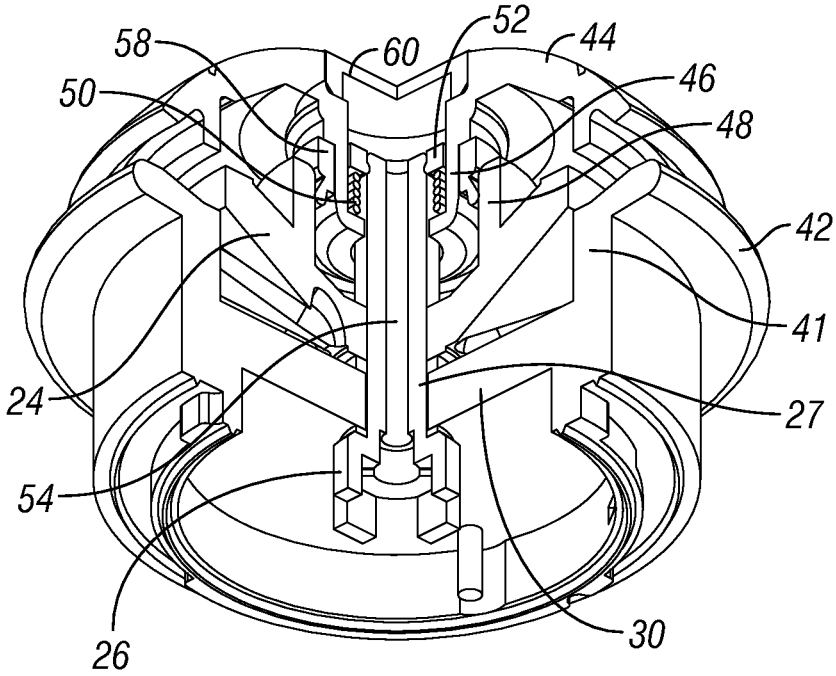
FIG. 6A and FIG. 6B are views similar to FIGS. 5A and 5B, respectively, taken from below.
Figure 6B:
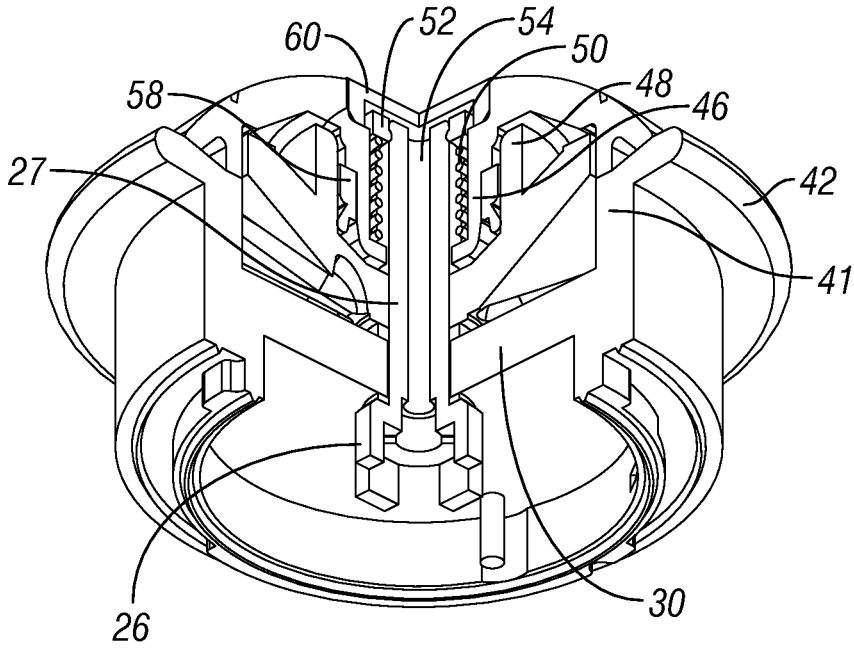

Referring to FIG. 5A, a cylindrical vertical wall 41 surrounds the nozzle plate 30 and is integrally formed therewith. A peripheral lip 42 extends radially outward from the upper end of the vertical wall 40 and is also integrally formed therewith. A dome-shaped cover 44 is configured for enclosing the stream deflector 24. A hydraulically actuated mechanism hereafter described supports the cover 44 above the stream deflector 24 for reciprocation relative to the stream deflector 24 between a lower closed position illustrated in FIG. 5B and a raised open position illustrated in FIG. 5A. The peripheral edge of the cover 44 engages the peripheral lip 42 surrounding the cylindrical wall 40 when the cover 44 is in its lower closed position to impede the ingress of dirt and debris into the flutes 32 of the stream deflector 24 and the orifice 31 in the nozzle plate 30. This seal also reduces evaporation of residual water and reduces or eliminates the formation of mineral deposits on the flutes 32 and the orifice 31 that would otherwise obstruct or eventually clog the same.

Referring to FIGS. 5A, 5B, 6A and 6B, the hydraulically actuated mechanism that raises and lowers the cover 44 includes a piston 46 integrally formed on the underside of the cover 44 and a cylindrical chamber 48 integrally formed on the upper side of the stream deflector 24 and in which the piston 46 reciprocates. A coil spring 50 provides a means for biasing the cover 44 to its lower closed position. Other biasing means could be used such as leaf springs or resilient compressible members. The coil spring 50 surrounds the clutch member 27 and is captured between the lower end of the piston 46 and a piston ring 52 snap fit to the upper end of the clutch member 27. When pressurized water to the sprinkler 10 is turned ON, the riser 12 extends upwardly. Water passes through a hollow bore 54 in the elongate clutch member 27 along a flow path 55 (FIG. 4) into the interior of the chamber 48. This forces the cover 44 to reciprocate upwardly. Water can enter the hollow bore 54 between the ninety-degree spaced apart fingers of the clutch dog 26 (FIG. 5A). When the pressurized water to the sprinkler 10 is turned OFF, the coil spring 50 immediately forces the cover 44 downwardly to its closed position. This occurs before the riser 12 retracts so that the cover 44 protects the nozzle formed by the stream deflector 24 and nozzle plate 30 before they reach ground level where debris could otherwise enter into the same. The periphery of the cover 44 is formed with an inverted Y-shaped flange structure 56 the inner shoulder of which snugly mates with the peripheral lip 42 to enhance the effectiveness of the seal. An elastomeric seal 58 (FIG. 7) surrounds the piston 46 and is positioned between the piston 46 and the interior wall of the chamber 48. A plug 60 is snap fit into a circular recess in the cover 44. A ring-shaped gasket or washer 62 surrounds the clutch member 27 and is positioned between the nozzle plate 30 and the stream deflector 24.

Figure 7:
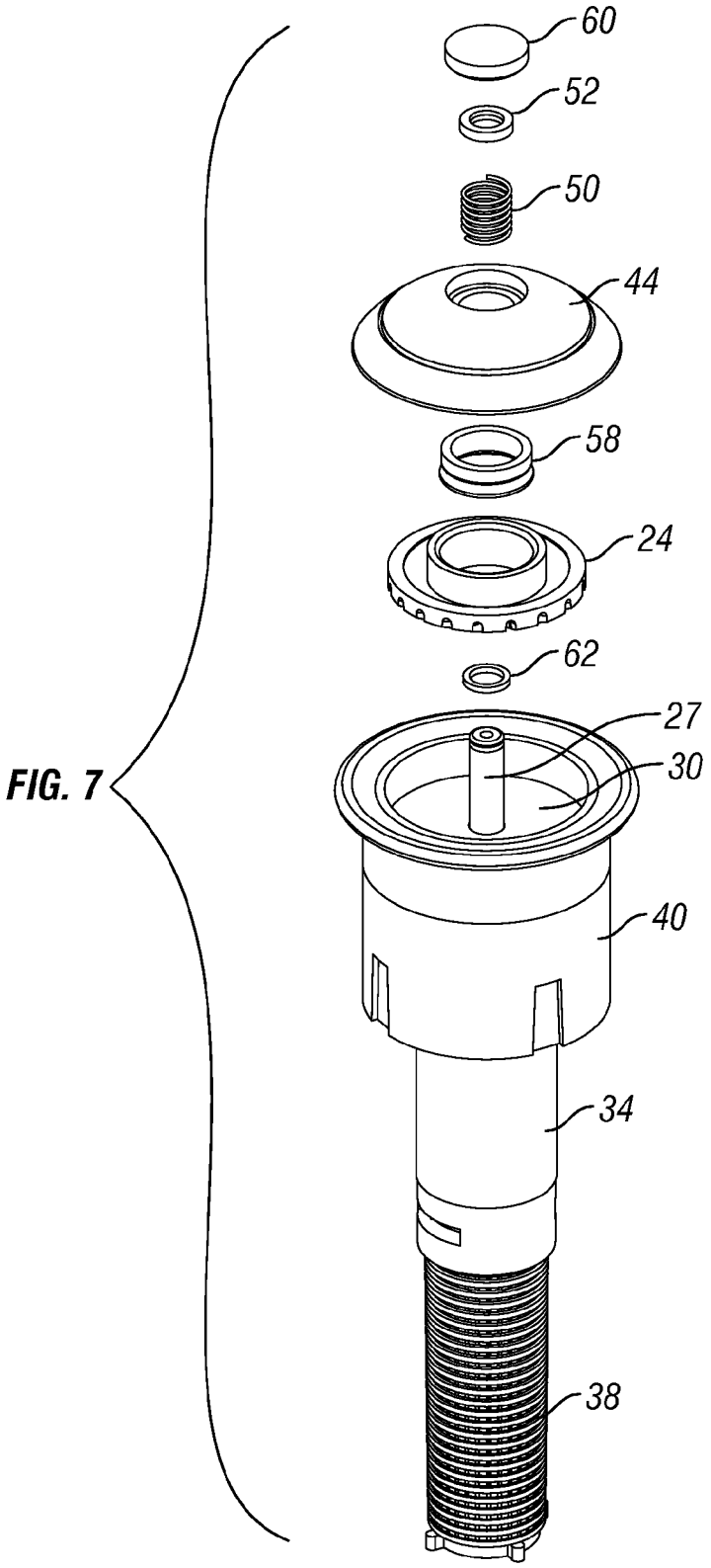
FIG. 7 is an exploded perspective view, taken from above, of the upper portion of the sprinkler of FIG. 1 that is mounted in the top of its riser.
Figure 9:
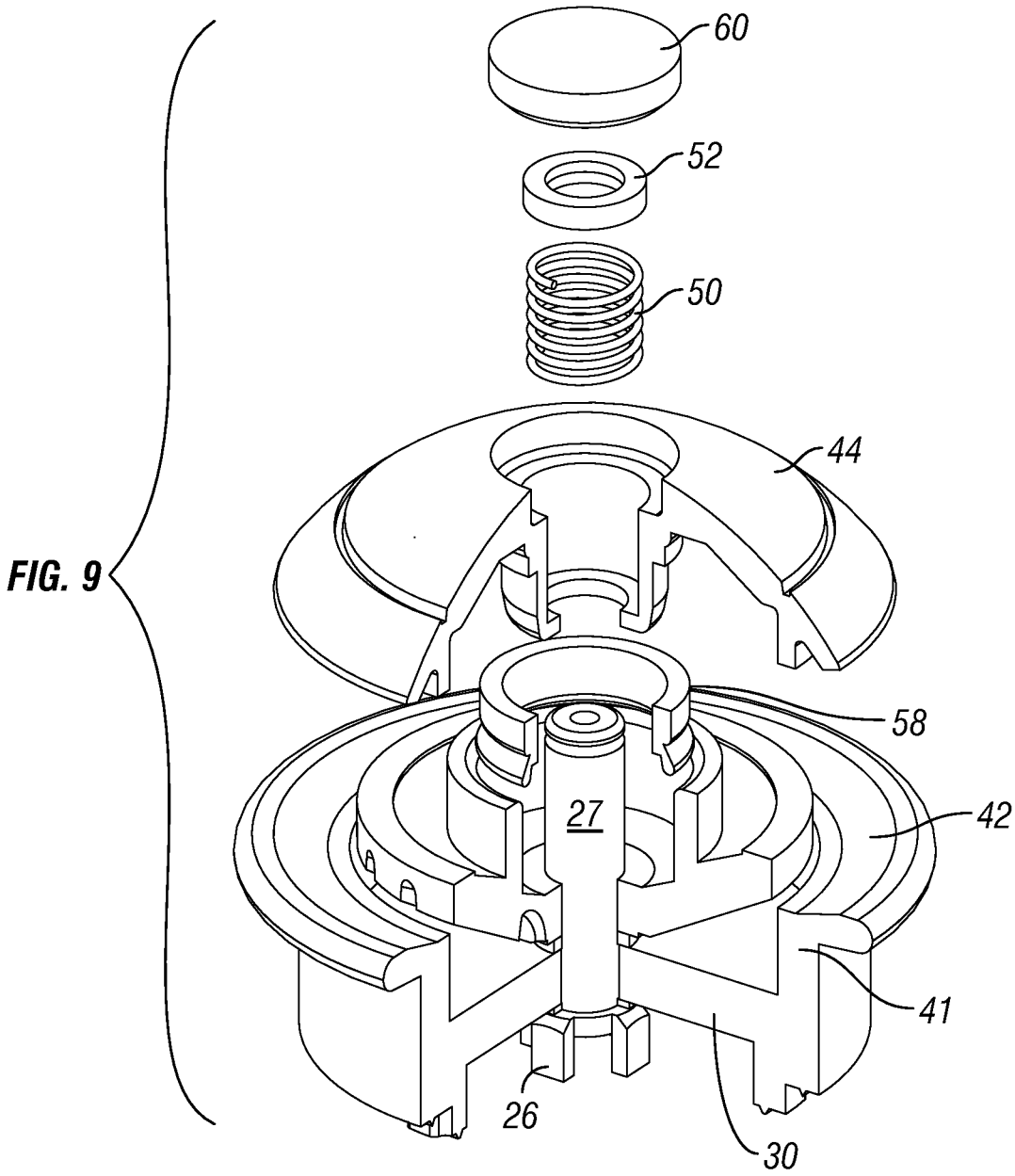
FIG. 9 is an exploded fragmentary perspective view, taken from above, of the nozzle and hydraulically actuated nozzle cover of the sprinkler of FIG. 1.

The exploded views of FIGS. 7, 8 and 9 illustrate the relationship of the various parts heretofore described with regard to the portion of the pop-up sprinkler 10 that screws into the upper end of the riser 12.

While I have described and illustrated an embodiment of a rotary stream sprinkler with a hydraulically actuated nozzle cover, it should be apparent to those skilled in the art that my invention can be modified in arrangement and detail. For example, the planetary gear reduction of sprinkler 10 can be operatively coupled in various different ways. For example, the gear box 28 could rotate and drive the stream deflector 24. Mechanisms can also be incorporated into the sprinkler 10 for adjusting the shape of coverage. It is not necessary to incorporate a means for biasing the cover 44 downward since it could fall downward under the force of gravity without a spring once the sprinkler 10 is de-pressurized. However, the biasing means enhances the integrity of the seal that prevents the ingress of debris and reduces the evaporation of residual water from the surfaces of the flutes 32 and the orifice 31 in the nozzle plate 30. The hydraulically actuated nozzle cover could also be incorporated into it other types of sprinklers besides gear driven rotary stream sprinklers, including rotary stream reaction drive sprinklers, spray nozzle type sprinklers, and gear-driven rotor-type sprinklers. Therefore, the protection afforded my invention should only be limited in accordance with the scope of the following claims.

I claim:

1. A sprinkler, comprising:

a rotary stream deflector with a plurality of stream forming flutes;

a nozzle;

means for supporting the rotary stream deflector for rotation about an axis relative to the nozzle;

a cover configured for enclosing the rotary stream deflector; and a hydraulically actuated mechanism that supports the cover above the rotary stream deflector for reciprocation relative to the rotary stream deflector between a lower closed position and a raised open position, the hydraulically actuated mechanism including:

a first flow path configured to direct water to raise the cover to the raised open position; and a second flow path configured to direct water to impinge upon the rotary stream deflector;

wherein the first flow path and the second flow path diverge below the rotary stream deflector, and wherein the cover is sufficiently elevated in the raised open position to allow a plurality of streams of water from the second flow path to be fully ejected by the rotary stream deflector without impingement by the rotary stream deflector.

2. The sprinkler of claim 1 and further comprising a peripheral lip surrounding the rotary stream deflector that is engaged by the cover when the cover is in its lower closed position to impede the ingress of dirt and debris into the rotary stream deflector and to reduce evaporation of residual water in the rotary stream deflector.

3. The sprinkler of claim 1 and further comprising means for biasing the cover to its lower closed position.

4. The sprinkler of claim 1 and further comprising a planetary gear train reduction coupled to the rotary stream deflector for rotating the same.

5. The sprinkler of claim 4 and further comprising a turbine located between the planetary gear train reduction and the rotary stream deflector and coupled to the planetary gear reduction for driving the rotary stream deflector.

6. The sprinkler of claim 1 wherein the hydraulically actuated mechanism includes a piston.

7. The sprinkler of claim 6 wherein the hydraulically actuated mechanism includes a cylindrical chamber in which the piston reciprocates.

8. The sprinkler of claim 7 wherein the piston is connected to an underside of the cover.

9. The sprinkler of claim 1 wherein the cover has a dome-shaped configuration.

10. A sprinkler, comprising:

a rotary stream deflector having a plurality of flutes;

a nozzle plate having at least one orifice located adjacent the rotary stream deflector;

a gear train reduction operatively coupled to the rotary stream deflector and configured to rotate the rotary stream deflector relative to the nozzle plate;

a turbine coupled to the gear train reduction for driving the rotary stream deflector;

a cover configured for enclosing the rotary stream deflector; and a hydraulically actuated mechanism that supports the cover above the rotary stream deflector for reciprocation relative to the rotary stream deflector between a lower closed position and a raised open position, the hydraulically actuated mechanism including:

a first flow path configured to direct water to raise the cover to the raised open position; and a second flow path configured to direct water to impinge upon the rotary stream deflector;

wherein the first flow path and the second flow path diverge below the rotary stream deflector, and wherein the cover is sufficiently elevated in the raised open position to allow a plurality of streams of water from the second flow path to be fully ejected by the rotary stream deflector without impingement by the rotary stream deflector.

11. The sprinkler of claim 10 and further comprising a peripheral lip surrounding the rotary stream deflector that is engaged by the cover when the cover is in its lower closed position to impede the ingress of dirt and debris into the flutes and the orifice and to reduce evaporation of residual water in the nozzle.

12. The sprinkler of claim 10 and further comprising means for biasing the cover to its lower closed position.

13. The sprinkler of claim 10 wherein the hydraulically actuated mechanism includes a piston.

14. The sprinkler of claim 13 wherein the hydraulically actuated mechanism includes a cylindrical chamber in which the piston reciprocates.

15. The sprinkler of claim 13 wherein the piston is connected to an underside of the cover.

16. The sprinkler of claim 10 wherein the cover has a dome-shaped configuration.

17. The sprinkler of claim 11 wherein the peripheral lip is connected to the nozzle plate.

18. The sprinkler of claim 13 and further comprising an elastomeric seal between the piston and a wall of the cylindrical chamber.

19. A sprinkler, comprising:

a rotary stream deflector having a plurality of flutes;

a nozzle plate having at least one orifice located adjacent the rotary stream deflector;

a gear train reduction operatively coupled to the stream deflector and configured to rotate the rotary stream deflector relative to the nozzle plate;

a turbine located between the gear train reduction and the nozzle plate and coupled to the gear train reduction for driving the rotary stream deflector;

a cover configured for enclosing the rotary stream deflector;

a hydraulically actuated mechanism that supports the cover above the rotary stream deflector for reciprocation relative to the rotary stream deflector between a lower closed position and a raised open position, the hydraulically actuated mechanism including:

a first flow path configured to direct water to raise the cover to the raised open position; and a second flow path configured to direct water to impinge upon the rotary stream deflector;

wherein the first flow path and the second flow path diverge below the rotary stream deflector, and wherein the cover is sufficiently elevated in the raised open position to allow a plurality of streams of water from the second flow path to be fully ejected by the rotary stream deflector without impingement by the rotary stream deflector;

a peripheral lip surrounding the rotary stream deflector that is engaged by the cover when the cover is in its lower closed position to impede the ingress of dirt and debris into the flutes and the orifice and to reduce evaporation of residual water in the nozzle; and means for biasing the cover to its lower closed position.

* * * * *